United States Patent [19]

Johnston

[11] 4,310,279

[45] Jan. 12, 1982

[54] TRASH HANDLING SYSTEM

[76] Inventor: J. L. Johnston, 222 El Grandada Blvd., El Grandada, Calif. 94018

[21] Appl. No.: 5,071

[22] Filed: Jan. 22, 1979

[51] Int. Cl.[3] ..... B65F 3/02

[52] U.S. Cl. ..... 414/408; 280/47.26; 414/406; 414/525 R

[58] Field of Search ..... 414/406–410, 414/525 R, 469, 517, 304, 419, 420; 280/47.18, 47.24, 47.26, 47.27, 47.28

[56] References Cited

U.S. PATENT DOCUMENTS

| | | | |
|---|---|---|---|
| 1,492,675 | 5/1924 | Clark et al. | 414/407 X |
| 2,569,609 | 10/1951 | House et al. | 414/420 |
| 3,374,004 | 3/1968 | Oliver | 280/47.26 |
| 3,458,071 | 7/1969 | Smith | 414/420 |
| 3,490,631 | 1/1970 | Smith | 414/525 X |
| 3,508,673 | 4/1970 | Pappas | 414/525 X |
| 3,627,159 | 12/1971 | Smith | 414/525 X |
| 3,647,095 | 3/1972 | Smith | 414/304 |
| 4,005,791 | 2/1977 | Stragier et al. | 414/420 X |
| 4,057,010 | 11/1977 | Smith | 414/525 X |

FOREIGN PATENT DOCUMENTS

| | | | |
|---|---|---|---|
| 630588 | 10/1949 | United Kingdom | 280/47.28 |

*Primary Examiner*—Sherman D. Basinger
*Assistant Examiner*—Terrance L. Siemens
*Attorney, Agent, or Firm*—B. Deon Criddle; Terry M. Crellin

[57] ABSTRACT

A trash handling system including apparatus to pick up, dump, compact and store refuse material, all of which may be provided on a single vehicle such as a trailer assembly. The trailer assembly may be connected through a suitable trailer coupling to a pickup vehicle or other prime mover. Trash material is placed in a trash bin which is designed to be picked up and transported by an easily operated hand truck. The trash bin is wheeled to the vehicle on the hand truck and both the trash bin and hand truck are connected to a folding and elevating chute located on the trash haul system. The trash bin and hand truck are raised by the folding and elevating chute and the contents of the automatically opening trash bin are dumped into a receiving trough. Once inside the receiving trough, the trash is compacted by a hydraulic ram, and is thereafter pushed into a storage chamber for further compaction. The trash haul system is emptied by hydraulically tipping the storage chamber, which is pivotally mounted on the trailer frame, and removing the compacted trash through a rear door assembly.

17 Claims, 10 Drawing Figures

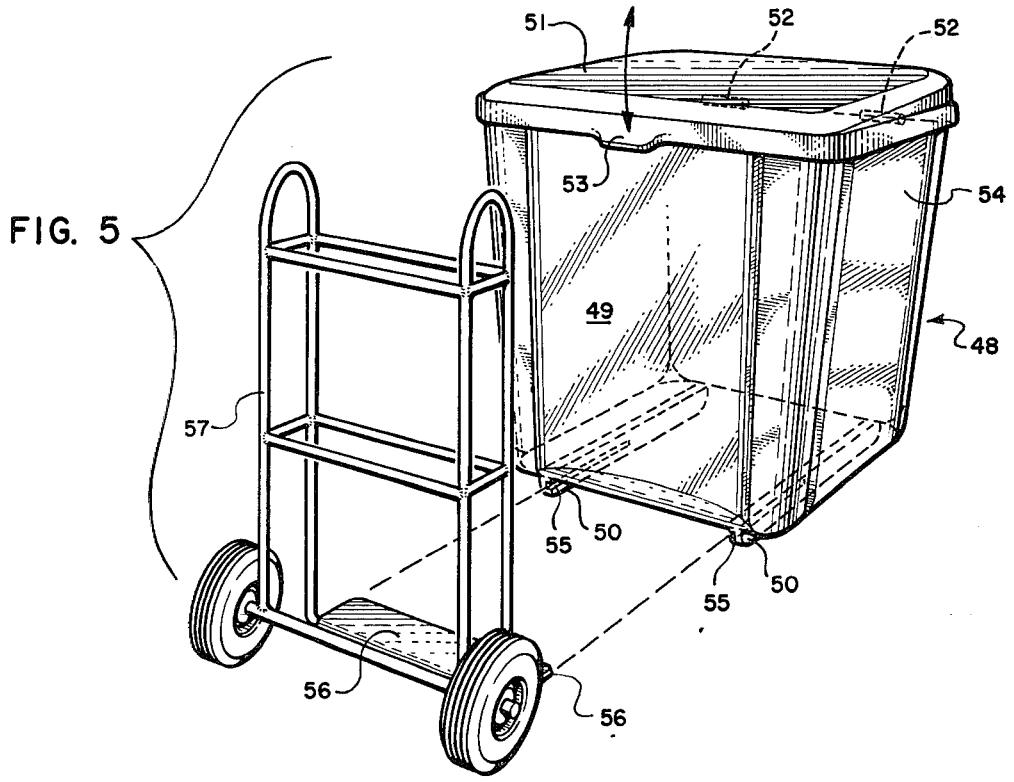
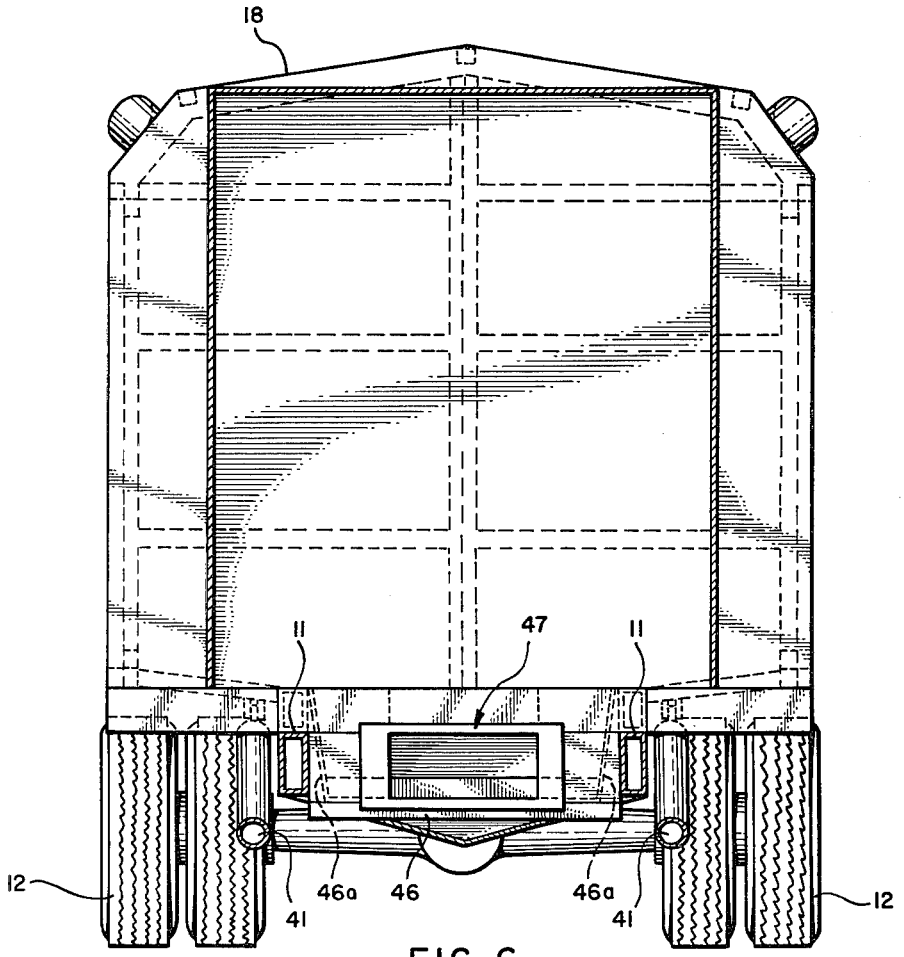
FIG. 6

TRASH HANDLING SYSTEM

BRIEF DESCRIPTION OF THE INVENTION

1. Field of the Invention

This invention relates to mobile trash collection and compaction systems.

2. Prior Art

Collection and disposal of man-made refuse and trash material has been a continuing problem for modern society. Use of individual garbage cans or trash bags, which are periodically picked up by a garbage collection truck, has proven to be a workable solution for many residential areas. However, in areas of high density population, such as apartment complexes or shopping centers, the use of individualized garbage cans or trash bags, each of which must be picked up by a large garbage collection truck, is inefficient and impractical, especially from a collection point of view. Accordingly, systems have evolved whereby an individual living or working in a high density polulation area, must carry, or arrange for someone else to carry, his individual trash to large, bulky, generally open topped, garbage collection bins. These large garbage bins are then mechanically picked up by specially adapted large garbage collection trucks, and the contents of the bins are noisely dumped into storage containers of the trucks. Such trucks are frequently fitted with a means for compacting the loosely dumped trash into the storage container in order to utilize their storage capacity more efficiently.

Unfortunately, the known trucks and bins are unsightly and their weight and size are such that they often cause physical damage to the surrounding environs. The trucks are often so large that they cannot be maneuvered in the narrow streets and cul-de-sacs provided around apartment complexes, for example. Yet, because they must continually be made capable of carrying larger pay loads in order to economically justify longer drives necessary to reach land fills or other dump areas, the trucks are continually made even larger. Moreover, the garbage bins, by necessity, have to be located in areas where the large trucks have easy access to them. Frequently, such locations are not convenient for those individuals who wish to dispose of their garbage. Therefore, some trash collection systems have been proposed that would eliminate the need to use these unsightly, large, heavy, and destructive bins and trucks. Such systems are especially needed in apartment complex areas, and like environs, where the pavement upon which the heavy trucks must travel is not designed to handle their heavy loads, and where the large bins cannot be conveniently located to the tenants who must use them.

In the past, the use of a trash collection trailer with a built-in compaction mechanism has been proposed. The advantages of using such a trailer are that the need to use a large, heavy, destructive truck is eliminated while efficient use of storage space is maintained. A properly designed trailer system will not only have a storage capacity equal to or greater than that of its large truck counterpart, but the loaded per wheel weight of the trailer and towing vehicle will be less than that of the empty weight of the large truck.

In U.S. Pat. No. 3,647,095, there is disclosed a Refuse-Collecting Apparatus and System which uses as one of its essential elements, a trailer that may be towed by a conventional, lightweight vehicle. The trailer therein disclosed is designed to be used with a stationary unit, into which the trash must be initially placed. A horizontal plunger pushes the trash from the stationary unit into the trailer, which is detachably coupled to the stationary unit. Once the trash is inside the trailer, a vertical plunger compacts it. One of the objectives of said invention is that the trailer may be left detachably coupled to the stationary unit, thereby allowing a great deal of refuse to be stored in the trailer before it must be towed away and emptied. Thus, the advantage of having a large storage capacity is maintained through the use of a large bulky garbage bin, but since garbage may be dumped by users only at a few usually inconvenient locations, the system is not entirely satisfactory. Also, in order to use the patented system, some source of external power must be available at the site of the stationary unit and the available sites for garbage collection are therefore limited.

None of the patents or prior art with which we are familiar disclose a trash haul system mounted on a single vehicle frame which incorporates the advantages of using a built-in, internally powered compacting system. Nor do any of the patents or prior art with which we are familiar disclose a vehicle mounted trash haul system designed to be compatible with trash bins that are lightweight, readily movable with the aid of a hand truck, and hence easily locatable in convenient areas. Also, the patents or prior art with which we are familiar do not disclose a trash haul system mounted on a single vehicle frame that includes internally powered, mechanical means for dumping the trash into the system without the need of physically lifting the trash container above ground level.

PRINCIPAL OBJECTS OF THE INVENTION

It is one of the objects of the present invention to provide an efficient, vehicle mounted, totally self-contained trash haul system which may be used in apartment complexes and like areas, thereby preventing damage to blacktop or cement surfaces which are not designed to handle the more conventional heavier refuse-collecting vehicles.

Another object is to provide a trash handling system wherein a maximum amount of trash may be carried by a vehicle so that the "pay load" carried, even by a relatively small vehicle will be sufficient to justify the costs involved.

It is a further object of the present invention to provide an efficient, lightweight trash handling system that is designed to be compatible with attractive, lightweight trash bins, thereby allowing said trash bins to be conveniently located throughout the apartment complex or like area.

Another object of the present invention is to provide a method whereby trash may be easily and quietly removed from the areas wherein the attractive, lightweight trash bins are located.

Still another object is to provide the means whereby the contents of the lightweight trash bins may be easily and quickly dumped into a trailer mounted trash handling system without spillage.

A further object is to provide a trash handling system including compacting means to compact the trash being handled with sufficient pressure, and which stores the compacted trash with sufficient density, to make the total trash capacity of the present invention competitive with the total trash capacity of the larger, heavier, trash trucks.

In addition, another object of the present invention is to provide a trailer-mounted trash handling system wherein all the power sources needed to load, compact, store, and dump trash are mounted on the trailer frame, thereby eliminating the need to have specially adapted towing vehicles, or external power sources, from which the power necessary to operate the system must be transferred.

PRINCIPAL FEATURES OF THE INVENTION

Principal features of the present invention in a trash handling system include a vehicle, which vehicle may be a trailer having a trailer frame, and a means for coupling the trailer frame to a pickup vehicle or other suitable prime mover. A receiving chamber, which has an upper input trough located thereon into which trash may be dumped, is carried on the vehicle frame. A powered ram at one end of the receiving chamber compacts the trash against a working surface located at the other end of the receiving chamber. Once the trash is compacted with a predetermined sensed pressure, a trap door opens to allow the powered ram to push the compacted trash into a storage chamber. The storage chamber is designed such that as the compacted trash is forced thereinto by the powered ram and a repositioning ram, it moves up a slanted ramp before piling up and falling back on itself. In this manner, all the available space within the storage chamber is efficiently filled.

Another feature of the invention provides easy unloading of the storage chamber. The storage chamber is pivotally mounted on the trailer frame. A power lift tilts the storage chamber about this pivotal mount, thereby dumping the compacted trash through a rear door assembly.

Still another feature allows lightweight trash bins to be easily emptied into the upper input trough located on the receiving chamber. A folding and elevating chute, mounted to the receiving chamber, is unfolded by powered means so that the trash bin, and the hand truck used to move the trash bin, may be detachably coupled thereto. Once coupled to the chute, the powered means elevates the chute, trash bin, and hand truck, thereby causing the contents of the trash bin to be dumped into the upper input trough. Once emptied, the chute lowers the trash bin and hand truck back to ground level where they may be readily detached, and the chute folds back up to a storage position.

A further feature of the invention allows attractive, lightweight trash bins to be easily and quietly moved by hand trucks. The bottom structure of the trash bins may be adapted to permit easy insertion of a conventional hand truck lifting plate thereunder. Once the lifting plate is inserted, it remains snugly in place, thereby eliminating the need of special belts or ropes to secure the trash bin to the hand truck.

Alternatively, for even better gripping of the trash bins, a special hand truck can be used. The special hand truck includes an upturned bead on the lifting plate, said bead being adapted to fit in a groove provided therefore on the bottom of the bin and a lip adapted to fit over the upper edge of the bin. Mechanical means are provided to move the bead and lip whereby the bin is securely clamped therebetween.

Additional objects and features of the invention will become apparent from the following detailed description taken together with the accompanying drawings and claims.

THE DRAWINGS

FIG. 1 is a perspective view of the trash haul system being towed by a pickup vehicle equipped with a fifth wheel trailer coupling;

FIG. 2, a side view of the trash haul system partially cut away and with the folding and elevating chutes removed so that the principal components involved in the compacting process may be readily viewed, and with the towing vehicle shown fragmentarily;

FIG. 3, a vertical cross section view taken on the line 3—3 of FIG. 2;

FIG. 4, a vertical cross section view taken on the line 4—4 of FIG. 2, and including the folding and elevating chutes, one of which is shown in its unfolded and elevated position with a trash bin and hand truck mounted thereon;

FIG. 5, a pictorial view of the trash bin designed to be used with the trash haul system, showing its relative size in relation to a conventional hand truck;

FIG. 6, a horizontal cross section view taken on the line 6—6 of FIG. 2;

FIG. 7, a fragmentary side view showing the rear portion of the trash haul system and with the storage chamber raised to an unloading position;

FIG. 8, a perspective view of another embodiment of a trash bin shown in a dumping position;

FIG. 9, a perspective view of a special hand truck usable with the trash bin of the invention; and FIG. 10, a vertical section, taken on the line 10—10 of FIG. 9.

DETAILED DESCRIPTION

Figure 1:
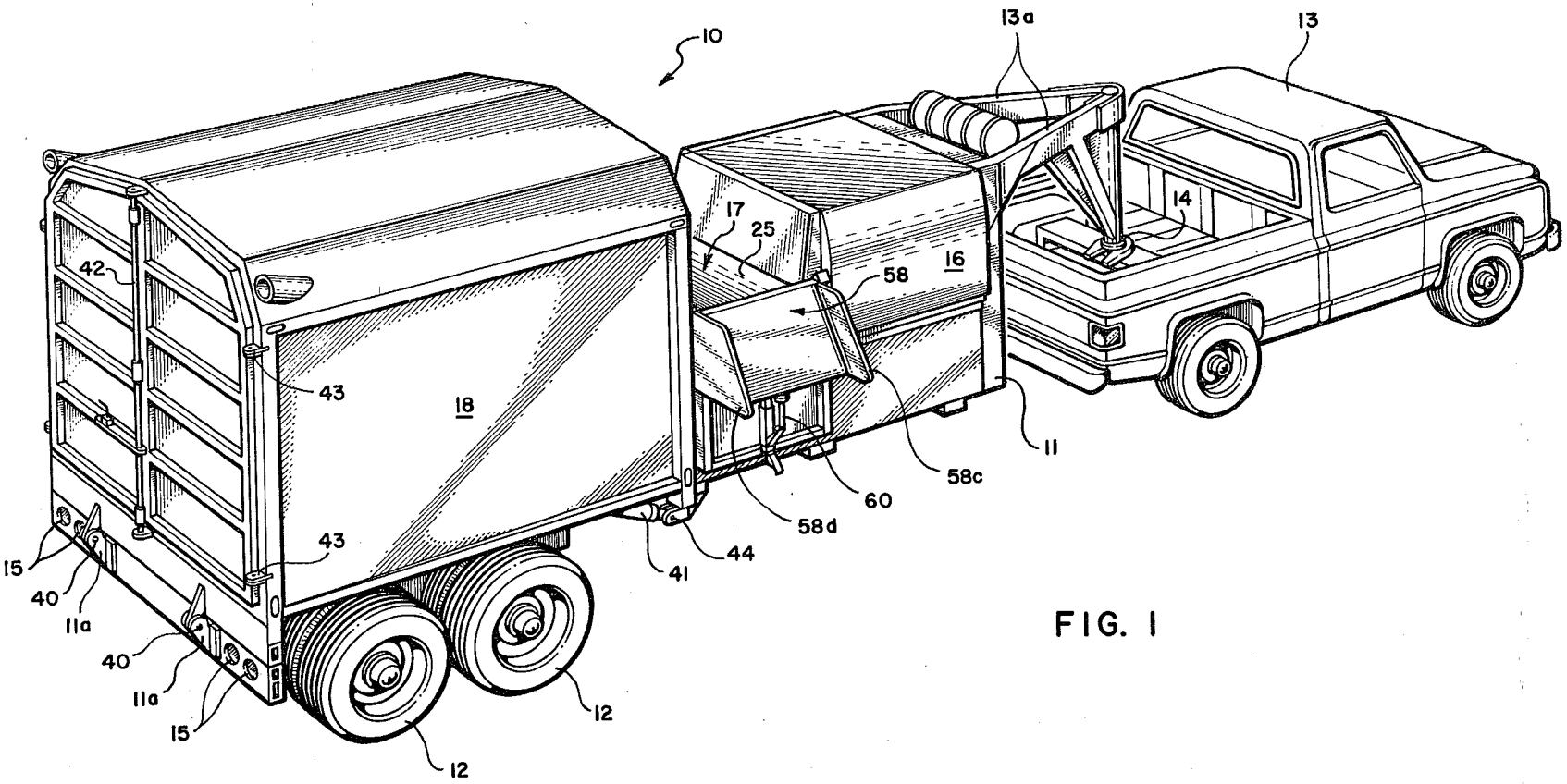

Referring now to the drawings:

In the illustrated preferred embodiment, the trash haul system, shown generally at 10, includes a trailer frame 11, supported in conventional fashion by dual sets of wheels 12. The trailer frame is coupled to a towing vehicle, here shown as a pickup truck 13, through an extension arm **13*a* that is connected to a fifth wheel trailer coupling 14. The trailer frame 11 includes conventional systems for suspension and braking which are not shown and the usual conventional electrical tail lights 15**.

Housings mounted on the trailer frame 11 form three main chambers, i.e., a power source chamber 16, a receiving chamber 17, and a storage chamber 18.

Figure 2:
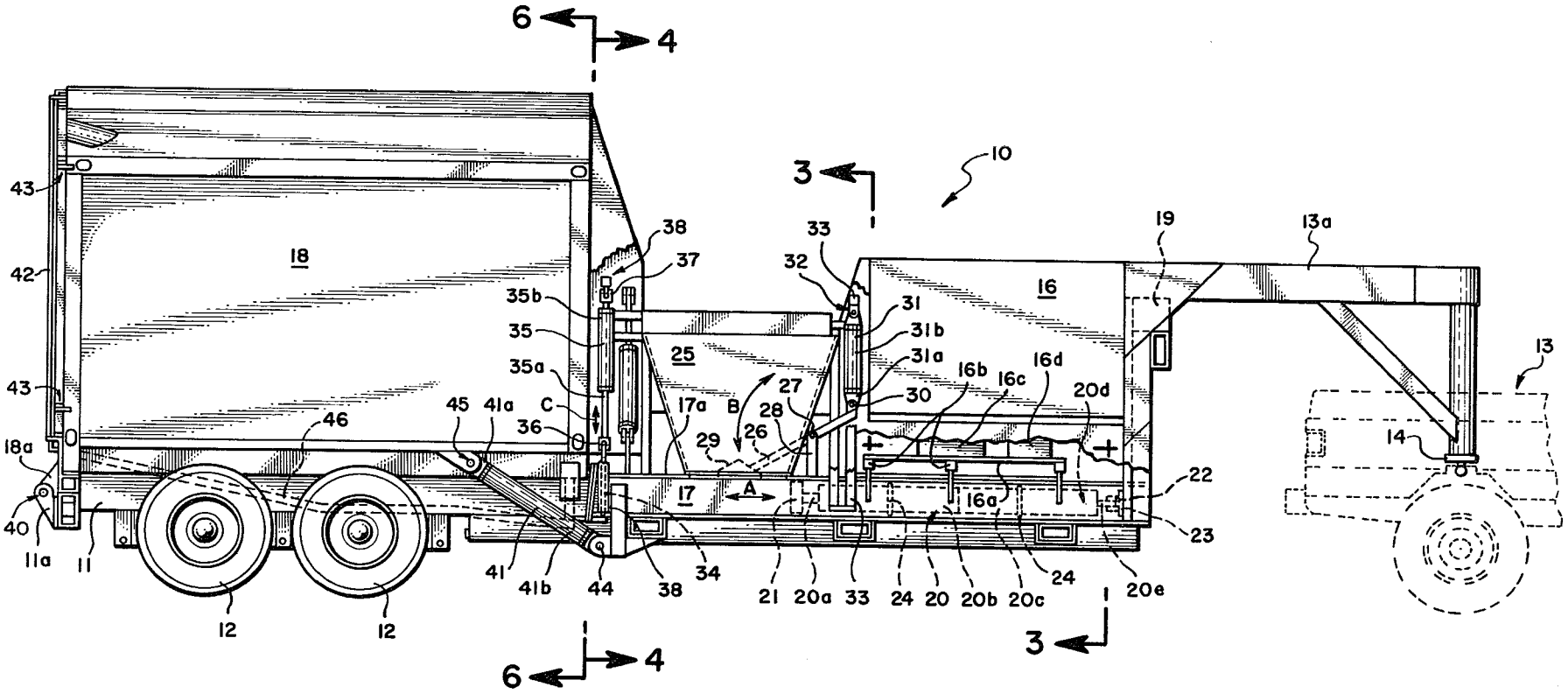
Figure 3:
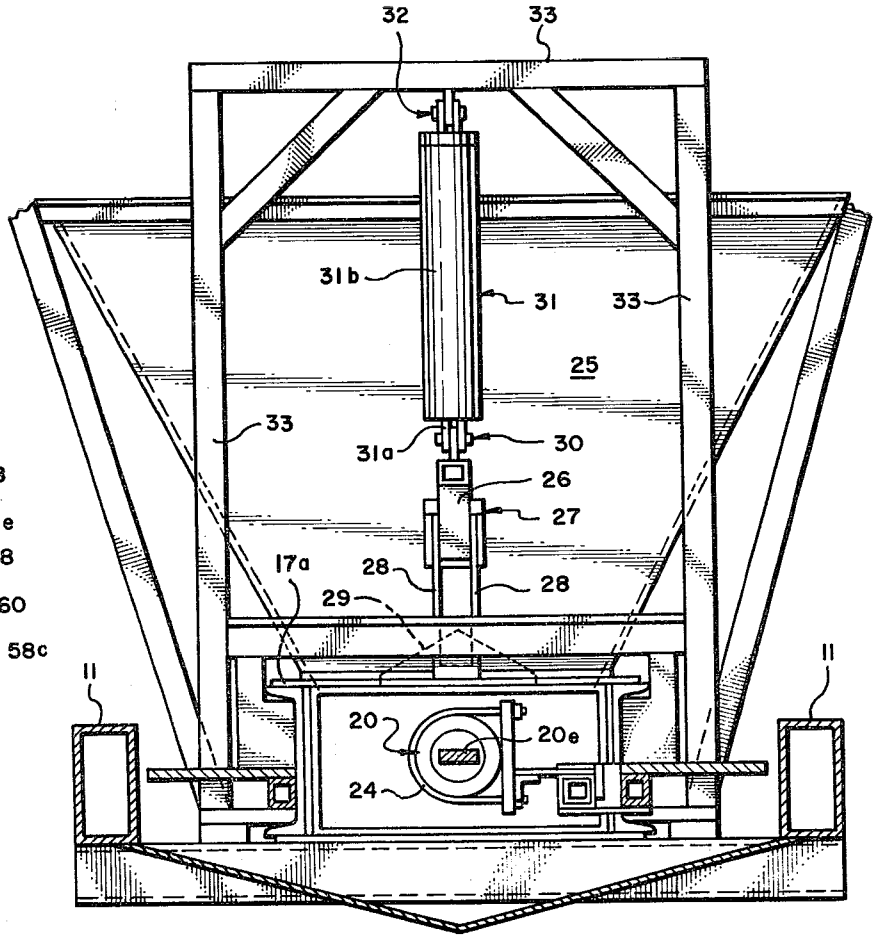

As best seen in FIG. 2, the power source chamber 16 includes a power source mounting plate **16*a*, mounted on cross braces 16*b* supported by the chamber housing. A hydraulic pump 16*c* and motor 16*d* are affixed to the mounting plate 16*a*. A hydraulic control box 19 is positioned outside the housing of chamber 16 and contains the usual controls for operating the hydraulic pump 16*c*, motor 16*d*, and hydraulic cylinders to be hereinafter described. A double hydraulic cylinder assembly 20, is located beneath the mounting plate 17*a*, and the rod 20*a* of a first hydraulic cylinder extends into one end of the receiving chamber 17. Rod 20*a* has a piston 21 thereon, which piston moves with the rod back and forth within the receiving chamber 17 when its housing 20*b* is abutted to the housing 20*c* of a second hydraulic cylinder 20*d*, the rod 20*e* of which is anchored by bolt 22 to flange 23 of the trailer frame 11. The abutted cylinder housings 20*b* and 20*c* are held to the frame 11 which being allowed to reciprocate, by U-bolts 24**, best seen in FIG. 3, that are mounted on the side of the receiving chamber 17. As best viewed in FIGS. 2 and 3, a feed hopper 25 is mounted on mounting plate 17*a*, and opens into chamber 17. A compacting lever 26 is pivotally mounted at 27 to a supporting post 28 and has one end extending into the feed hopper 25 to carry a compacting head 29. The other end of the compacting lever 26 is pivotally attached at 30 to the rod 31*a* of hydraulic cylinder 31. Reciprocation of the rod 31*a* will thus swing the compacting head 29 in an arc, as shown by the arrow B in FIG. 2. The housing 31*b* of the hydraulic cylinder 31 is attached at 32 to a support brace 33 that is affixed to the housing of chamber 16.

Figure 4:
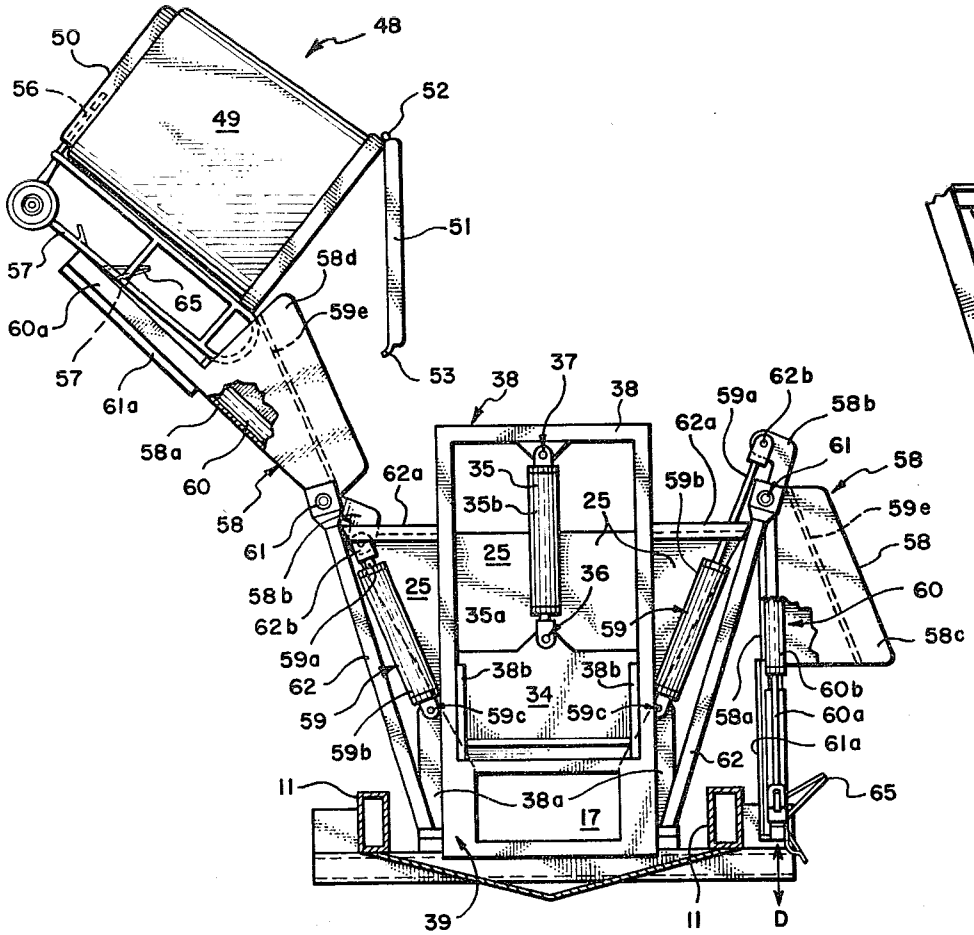

A gate 34 is provided at the other or discharge end of the receiving chamber 17. The gate is raised or lowered by operation of a hydraulic cylinder 35, as indicated by the arrow C in FIG. 2 where the gate 34 is shown in its lowered, or closed position. In FIG. 4 the gate 34 is shown in its raised, or open position. The cylinder rod 35*a* of hydraulic cylinder 35 is attached at 36 to the gate 34 and the cylinder housing 35*b* is attached at 37 to a support structure shown generally at 38. The support structure 38, seen best in FIG. 4, includes a frame 38*a* attached to and extending upwardly from trailer frame 11 at the discharge end of the chamber 17. Guides 38*b*, affixed to upright posts of the frame 38*a*, confine the gate 34 to motion in a vertical plane.

Figure 7:
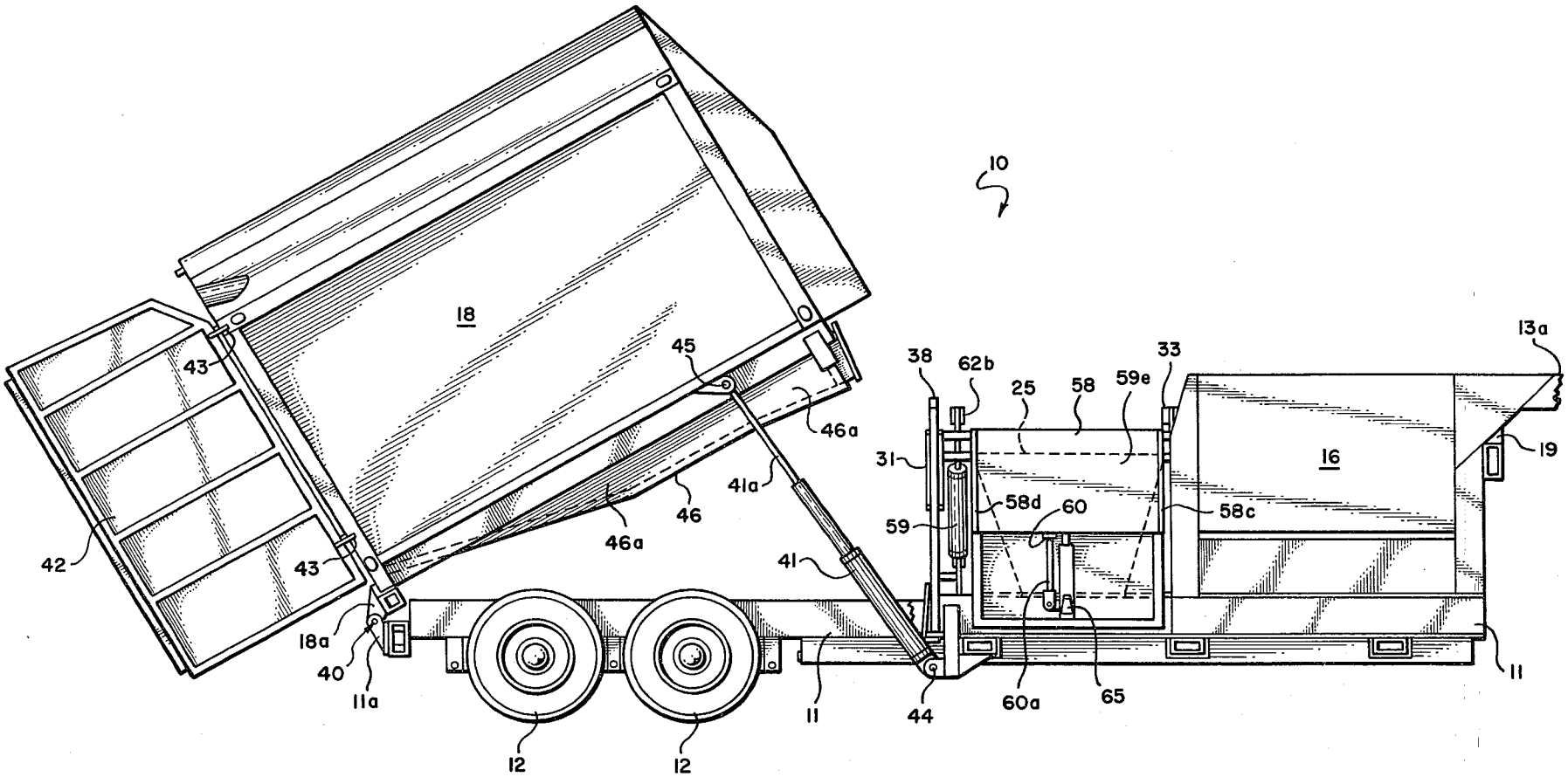

As best seen in FIGS. 2 and 7, the storage chamber 18 is pivotally mounted to the trailer frame 11 by pivot pins 40 inserted through matching ears 18*a* and 11*a* on the storage chamber and trailer frame 11, respectively. A pair of hydraulic cylinders 41 tilt the storage chamber to the unloading position shown in FIG. 7. A rear door assembly 42 is hinged at 43 to the rear of storage chamber 18. FIG. 7 shows the rear door assembly 42 in its open position. Conventional locking mechanisms, not shown, are provided to hold the rear doors shut and to latch the storage chamber in its lowered, load receiving position. The ends of the rods 41*a* of hydraulic cylinders 41 are pivotally connected to flanges on the storage chamber 18 and the housings 41*b* of the cylinders are pivotally mounted to the trailer frame 11 at 44.

An inclined loading ramp 46 is suspended by walls 46*a* beneath the front of the storage chamber 18, and is centrally positioned with respect to the chamber. The incline of the loading ramp 46 is best shown in dotted lines in FIG. 2, and may also be seen in FIG. 7 while the entrance to the loading ramp 46 is best seen generally at 47 in FIG. 6. The lower forward end of the loading ramp 46 is positioned immediately behind the gates 34 when the chamber 18 is in its lowered loading position. The ramp 46 is fully exposed inside the storage chamber 18 and the upper rear end of the ramp terminates at floor level in the chamber 18 and at the rear doors.

Trash bins of the type shown at 48 in FIG. 5 are specially designed to be used with the trash haul system 10. Each trash bin 48 includes a box-like container 49, which rests on bottom spaced apart, parallel side skids 50, and a lid 51, which is hinged at 52 to the top of the container 49 at the back thereof. A handle 53 protrudes from the front side of the lid 51 to facilitate pivotal opening and closing of the lid. The outer periphery of the lid 51 forms a lip that extends downwardly around the upper end of container 49 to effectively seal the same. The skids 50 each have a longitudinal groove 55 located on their inside edge. The skids are spaced so that the bottom lifting plate 56 of a conventional hand truck 57 will snugly fit therebetween at the front of the bin, with the side edges of plate 56 fitted into the grooves 55 in the skids. The trash bin 48 is then easily transported with the aid of the hand truck to a location where the contents of the bin can be easily dumped into the feed hopper 25 mounted on the receiving chamber 17.

The trash haul system 10 further includes two folding and elevating chutes 58 which are attached to the receiving chamber 17 and the feed hopper 25 mounted thereon. As best seen in FIG. 4, the folding and elevating chutes 58 are located on opposite sides of the feed hopper 25. A pair of hydraulic cylinders 59 are used to operate each of the folding and elevating chutes. The cylinders 59 serve as folding and elevating cylinders that rotate the chutes 58 from a stowed position, through a trash pickup position, to a trashs dumping position. The chutes 58 are pivotally connected at 61 to angled arms 62 that project upwardly and outwardly from trailer frame 11 at the outer edges of the feed hopper 25 and that are reinforced by braces 62*a* interconnecting the arms 62 with the support structure 38 previously described.

Each chute 58 has a backing plate 58*a* that is pivotally connected at 61 and that projects beyond the pivot connection in one direction to form a hook 58*b*. The hydraulic cylinder 59 used to operate the chute has its rod 59*a* pivotally connected to the hook 62*b* and its housing 59*b* pivotally connected at 59*c* to a guide 38*b* forming a part of the support structure 38. The backing plate 58*a* extends beyond the pivot 61 in the opposite direction to mount a hydraulic cylinder 60 to reciprocate a slide plate 61*a* with respect to the backing plate. The slide plate 61*a* is fixed to and is carried by the rod 60*a* of hydraulic cylinder 60 and the cylinder housing 60*b* is fixed to the backing plate 58*a*.

Each chute 58 also includes a pair of spaced apart side walls 58*c* and 58*d* projecting from opposite edges of the backing plate and a chute bottom plate 59*e* extending between the spaced apart side walls and angled from a location spaced away from the backing plate 58*a* at the rod end of cylinder 60 to a location proximate to the pivot connection 61. As will become more apparent hereinafter, when the chute 58 is raised to its elevated dumping position, the chute bottom plate 59*e* is essentially aligned with an inclined wall of the feed hopper 25.

The housing 60*b* of hydraulic cylinder 60 is fixed to the backing plate 58*a* beneath the chute bottom plate 59*e*, and as the rod 60*a* is expelled or retracted with respect to the housing 60*b*, the slide plate 61*a* affixed thereto is moved. Thus, when the chute is lowered to its trash pickup position the hydraulic cylinder 60 can be actuated to move the slide plate downward such that a hand truck and trash bin can be conveniently attached thereto. Thereafter, the cylinder 60 can be actuated to move the slide plate 61*a* up such that an upper lip of the attached trash bin will be adjacent to a lower edge of the chute bottom plate 59*e*. Thus, as will be further explained, when the chute 58 is raised, trash from a trash bin carried by the slide plate will fall from the bin directly onto the chute bottom plate 59*e* to be guided by the spaced apart side walls 58*c* and 58*d* into the feed hopper 25.

A finger 65 projects from a forward face of the slide plate 61*a* to engage a cross-bar of the frame of a hand truck such as is shown at 57. Hydraulic cylinder 60 is operated to move the slide plate 61*a* such that finger 65 will extend into an opening between cross-bars of the hand truck and is then operated to move the finger to engage a cross-bar and to pick up the hand truck and a trash bin carried by the hand truck as an interlocked unit. The cylinder 60 is operated to move the slide plate until the trash bin engages the chute 58 and the interlocked hand truck and trash bin unit is securely held with respect to the chute 58 during raising and lowering of the chute.

In operation of the trash haul system of the invention, lid 51 is raised and trash or refuse is placed inside trash bins 48 in a conventional manner (FIG. 5). When a bin is to be emptied, a conventional hand truck 57 is used to move the trash bin 48 to where it is accessible to the trash haul system 10. The hand truck and trash bin form a unit that is attached to the slide plate 61*a* of the folding and elevating chute 58 in the manner previously described. After it is attached to the slide plate 61*a*, the trash bin is elevated to its dumping position by energizing hydraulic cylinder 59 (FIG. 4). Concurrent with the elevating of the trash bin, or prior thereto, the hydraulic cylinder 31 is activated to raise the compacting head 29 (FIG. 2) to its uppermost position. As the bin is raised, the lid 51 thereof swings open to permit the contents of the bin to fall onto chute bottom plate 59*e* and from there into the feed hopper 25.

After the contents of the trash bin have been dumped into the feed hopper 25, hydraulic cylinder 31 lowers the compacting head 29 to force the bulk of the trash located within the feed hopper 25 into the receiving chamber 17. With the gate 34 in its down, i.e., closed position, the piston 21, controlled by the hydraulic cylinder comprising rod 20*a* and housing 20*b* repeatedly forces the trash against the gate, thereby compacting the trash. A conventional pressure relief valve, not shown, controls the pressure applied through rod 20*a* and regulates the stroke of the rod and the degree of compaction of the trash against gate 34. After the rod 20*a* has been reciprocated one or more times, as determined to be necessary for complete compaction, the rod 20*a* is retracted to relieve the pressure applied to gate 34. Thereafter, hydraulic cylinder 35 automatically lifts the gate 34. Once the gate is open, both rods 20*a* and 20*e* are extended and the piston 21 pushes the compacted trash all the way through the gate frame 39 and onto the inclinded loading ramp 46 located at the bottom and center of the storage chamber 18.

The rods 20*a* and 20*e* are then retracted to pull the piston 21 back through the gate frame 39 and receiving chamber 17 so that the compaction cycle may begin over again. With each compaction cycle, the compacted trash is forced further up the inclined loading ramp 46. As the trash builds up, it eventually falls back on itself, thereby spilling over into the main storage area of the storage chamber 18. In this fashion, maximum use is made of all the available storage space within the storage chamber 18. Furthermore, as the trash fills the storage chamber and more trash is forced in by the piston 21 additional compaction takes place in the storage chamber. Thus, the trash is initially compacted so that a maximum amount of the trash can be placed in the storage chamber and then it is compacted within the storage chamber to insure that all available space is utilized, thus insuring that the maximum amount of garbage is transported in the vehicle.

The storage chamber 18 is emptied by opening the rear doors 42 and operating hydraulic cylinders 41 to tilt the storage chamber 18 about its pivot pins 40, thereby dumping the contents from the storage chamber.

Figure 8:
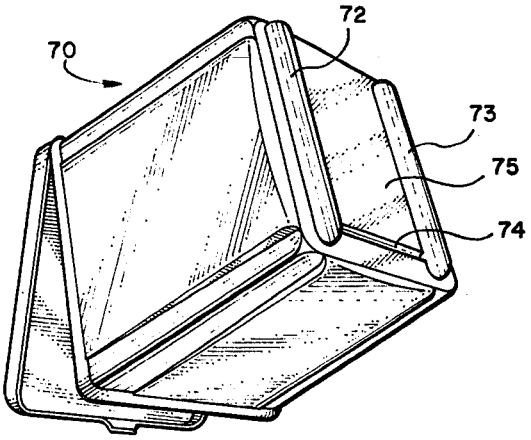
Figure 9:
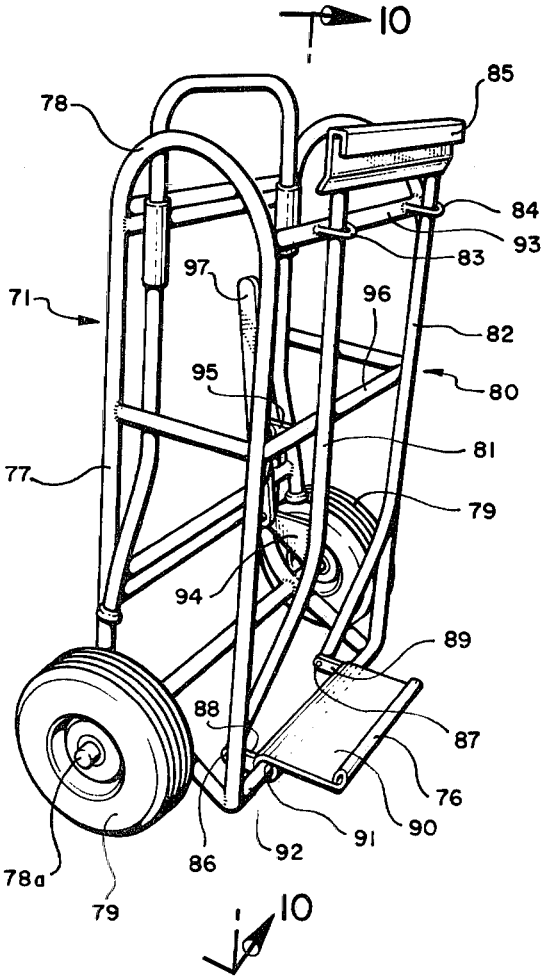
Figure 10:
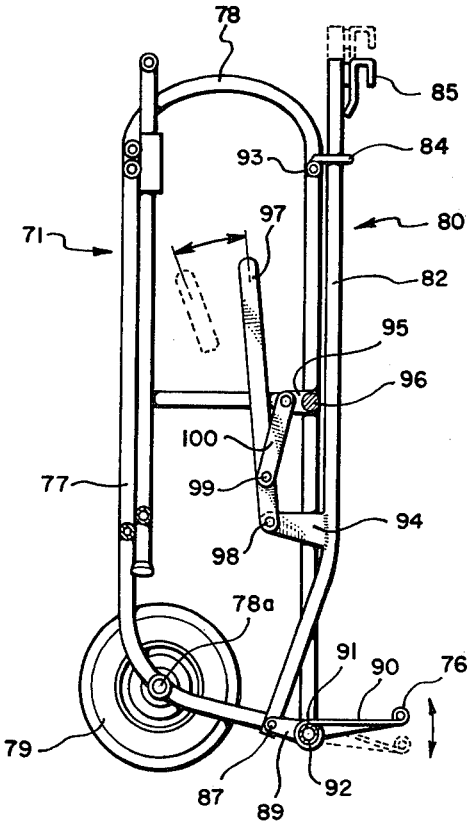

FIGS. 8–10 show a special trash bin 70 and special hand truck 71 that can be used in place of the trash bin 48 and conventional hand truck 57 previously described.

As best seen in FIG. 8, the special trash bin 70 is constructed in the same manner as the trash bin 48, previously described, except that the skids 72 and 73 do not have grooves in their inside edges such as are found on the skids 50 of the bin 48. Bin 70 has a groove 74 extending transversely between skids 42 on the underside of bottom 75 and at the forward edge of the bottom. The groove 74 is adapted to receive the upwardly extending lip 76 of the special hand truck 71, as will be further explained.

The hand truck 71 is adapted to pick up and securely clamp the trash bin 70. To accomplish this, the hand truck is provided with the usual hand truck frame 77, including handles 78, a wheel support shaft 78*a*, and wheels 79 journaled on opposite ends of the shaft.

A clamping mechanism, shown generally at 80 is carried by the frame 77. The clamping mechanism includes a pair of curved, elongate, spaced apart, back rails 81 and 82 respectively adapted to slide through brackets 83 and 84 fixed to an upper cross brace 93 of the hand truck frame 77. The upper ends of the back rails are interconnected by an elongate hook 85 that is adapted to fit over an upper edge of a trash bin, as will be hereinafter further described. The lower ends of the back rails 81 and 82 are curved inwardly with respect to the front of the hand truck frame to be pivotally connected at 86 and 87 respectively to arms 88 and 89 projecting rearwardly from a bottom lift plate 90.

The bottom lift plate 90 is journaled at 91 to a lower cross brace 92 of the hand truck frame 77 and projects forwardly from the hand truck frame to terminate in the upwardly extending rolled lip 76.

A bracket 94 is fixed to and projects rearwardly from the back rail 81 and another bracket 95 is carried by a central cross brace 96 of the hand truck frame 77. An operating handle 97 has one end pivotally connected at 98 to the bracket 94 and is pivotally connected at 99 intermediate its length, to a link 100. The link 100 is pivotally connected at its ends to the bracket 95 and operating handle 97. It will be apparent that raising of the free end of the handle 97 will lower the back rails 81 and 82 and their interconnected hook 85. At the same time, the downward movement of the back rails will push down on the arms 88 and 89 to pivot the plate 90 upwardly. When the free end of handle 97 is raised to move the pivot connection 98 below the pivot connection 99 the clamping mechanism is positioned such that the hook 85 is lowered while the rolled lip 76 is raised.

When the free end of handle 97 is lowered, the back rails 81 and 82 are raised, along with the hook 85, and the lift plate 90 is pivoted to lower the rolled lip 76.

When the hand truck 71 is used, with the trash bin 70, the handle 97 is lowered and the hand truck is positioned such that the hook 85 is above the front of the upper edge of the trash bin while the lift plate 90 is positioned between the skids 72 and 73, with the rolled lip beneath the groove 74. Raising of handle 97 will then move the hook 85 down to grip the top of the forward edge of the trash bin and the lip 76 into the groove 74 at the bottom of the trash bin. The handle 97 is securely held against undesired rotation by the movement of the pivot connection 98 over center with respect to the pivot connection 99. With the hand truck 71 and trash bin 70 interlocked the hand truck may be readily attached to a slide plate 61*a* of the folding and elevating chute 58, as previously described.

Although a preferred form of our invention has been herein disclosed, it is to be understood that the present disclosure is by way of example and that variations are possible without departing from the subject matter coming within the scope of the following claims, which subject matter we regard as our invention.

We claim:

1. A trash handling system comprising a vehicle having a frame;

a receiving chamber carried by said frame, said receiving chamber having a feed hopper at a top thereof through which trash and the like may be dropped into the receiving chamber;

a storage chamber carried by said frame at one end of said receiving chamber;

means forming an opening interconnecting the interior of the receiving chamber and the interior of the storage chamber;

a gate arranged to close the opening interconnecting the interior of the receiving chamber and the interior of the storage chamber;

means for moving the gate between its closed position and an open position; and means carried by said frame for compressing trash and the like in the receiving chamber against the gate when said gate closes the opening and for moving compressed trash and the like from the receiving chamber to the storage chamber when the said gate is opened.

2. A trash handling system as in claim 1, further including means to force trash and the like from the feed hopper to the receiving chamber.

3. A trash handling system as in claim 2, wherein the means to force trash and the like from the feed hopper to the receiving chamber comprises a compacting head movable in the feed hopper to push trash and the like therefrom downwardly into the receiving chamber.

4. A trash handling system as in claim 3, wherein the compacting head is mounted on one end of a pivotally mounted arm projecting through a wall of the feed hopper and is movable between a raised position permitting trash and the like to fall through the feed hopper and a compacting position extending substantially across the feed hopper to force trash and the like from the feed hopper into the receiving chamber.

5. A trash handling system as in claim 1, wherein the means for moving the door between its closed position and an open position opens the door after compaction of the trash and the like in the receiving chamber.

6. A trash handling system as in claim 1, further including means for dumping trash and the like into the feed hopper, said means for dumping trash into the feed hopper including at least one folding and elevating chute pivotally attached with respect to said receiving chamber; and means for moving said chute between a lowered position alongside the receiving chamber and a raised position wherein said chute is directed into said receiving chamber.

7. A trash handling system as in claim 6, further including a trash bin;

a hand truck;

means for interlocking said trash bin and hand truck together as a unit; and means for attaching said unit to one said elevating and folding chute whereby upon movement of said chute to its position wherein the chute is directed into the receiving chamber the trash bin is elevated and tipped to discharge the contents thereof into the chute to be directed into the receiving chamber.

8. A trash handling system comprising a vehicle having a frame;

a receiving chamber carried by said frame, said receiving chamber having a feed hopper opening thereinto;

a storage chamber carried by said frame at one end of said receiving chamber; and means mounted on said frame at an opposite end of said receiving chamber for compacting trash in said receiving chamber and for forcing said compacted trash from said receiving chamber into said storage chamber, said means for compacting trash in said receiving chamber and moving the compacted trash into said storage container comprising a gate separating the receiving chamber from the storage container, means mounted on said vehicle frame for opening and closing said gate, and piston means extending into said receiving chamber to compact trash within said receiving chamber against said gate when said gate is closed, and to move compacted trash from said receiving chamber into said storage chamber when said gate is open, said piston means comprising a piston slidable through the receiving chamber, a first hydraulic cylinder housing, a cylinder rod projecting from one end of the hydraulic cylinder housing and carrying the piston, a second hydraulic cylinder housing having an end fixed to the other end of the first hydraulic cylinder housing, and a second cylinder rod extending from the second hydraulic cylinder housing and fixed to the vehicle frame whereby actuation of the first cylinder rod will move the piston to crush trash against the gate and simultaneous actuation of the first and second cylinder rods moves the piston to force compacted trash into the storage container.

9. A trash handling system as in claim 8, further including guide means extending into said storage chamber to guide compacted trash forced therein by said piston means.

10. A trash handling system as in claim 9, wherein guide means extending into the storage chamber comprises an inclined loading ramp centrally located beneath the storage chamber, said inclined loading ramp being positioned so that one end is immediately behind and at the bottom of the gate to receive compacted trash forced into one end of said storage chamber by the piston means, and extending upwardly into the principal storage area of said storage chamber at a location flush with the bottom of the other end of said storage chamber, thereby allowing compacted trash to be forced up said inclined loading ramp.

11. A trash handling system as in claim 10, wherein the storage chamber is pivotally mounted on the vehicle frame;

a rear door assembly is hinged on said storage chamber to facilitate removal of compacted trash therefrom; and means are attached to said vehicle frame to tilt said storage chamber about its pivot mounts, thereby dumping compacted trash therefrom.

12. A trash haul system as in claim 11, wherein the vehicle comprises a trailer and further including means for coupling the vehicle frame to a prime mover.

13. A trash handling system as in claim 12, wherein the means for coupling said vehicle frame to said prime mover is a fifth wheel trailer coupling.

14. A trash handling system comprising a vehicle having a frame;

a receiving chamber carried by said frame, said receiving chamber having a feed hopper opening thereinto;

a storage chamber carried by said frame at one end of said receiving chamber; and means mounted on said frame at an opposite end of said receiving chamber for compacting trash in said receiving chamber and for forcing said compacted trash from said receiving chamber into said storage chamber, said means for compacting trash in said receiving chamber and moving the compacted trash into said storage container comprising a gate separating the receiving chamber from the storage chamber, means mounted on said vehicle frame for opening and closing said gate, and piston means extending into said receiving chamber to compact trash within said receiving chamber against said gate when said gate is closed, and to move compacted trash from said receiving chamber into said storage chamber when said gate is open.

15. A trash handling system as in claim 14, wherein the vehicle comprises a trailer; and further including means for coupling the trailer frame to a prime mover.

16. A trash handling system comprising a vehicle having a frame; a receiving chamber carried by said frame to receive trash and the like;

means for dumping trash and the like into the receiving chamber, said means for dumping including a folding and elevating chute pivotally attached with respect to said receiving chamber;

means for moving said chute between a lowered position alongside the receiving chamber and a raised position wherein said chute is directed into said receiving chamber;

a trash bin;

a hand truck;

means for interlocking said trash bin and said hand truck together as a unit; and means for attaching said unit to said elevating and folding chute whereby upon movement of said chute to its position wherein the chute is directed into said receiving chamber the trash bin is elevated and tipped to discharge the contents into the chute to be directed into the receiving chamber.

17. A trash handling system as in claim 16, wherein the elevating and folding chute has a slide plate affixed thereto and means for moving said slide plate towards and away from the chute and wherein said means for attaching the unit comprising the trash bin and hand truck is carried by said slide plate.

* * * * *